US005307860A

United States Patent [19]

Wilkinson et al.

[11] Patent Number: 5,307,860

[45] Date of Patent: May 3, 1994

[54] DRAPERY SUPPORT SYSTEM

[76] Inventors: Gladys J. Wilkinson; James G. Wilkinson, both of 4723 Blackrock, Baytown, Tex. 77521

[21] Appl. No.: 54,627

[22] Filed: Apr. 30, 1993

[51] Int. Cl.[5] ..... A47H 13/14

[52] U.S. Cl. ..... 160/348; 248/300

[58] Field of Search ..... 248/208, 251, 252, 253, 248/261, 262, 300; 160/348, 349.1, 349.2

[56] References Cited

U.S. PATENT DOCUMENTS

| | | | |
|---|---|---|---|
| 1,345,340 | 7/1920 | Alphin | 248/253 |
| 1,513,401 | 10/1924 | Krick | 248/252 |
| 1,530,276 | 3/1925 | Mehalska | 248/252 |
| 1,805,926 | 5/1931 | Scott | 248/252 |
| 2,588,203 | 3/1952 | Cameron | 160/348 |
| 2,944,782 | 7/1960 | Newcomb | 248/261 |
| 3,203,469 | 8/1965 | Falkenberg | 160/348 |
| 3,417,807 | 12/1968 | Falkenberg | 160/348 |
| 4,958,646 | 9/1990 | Hannershig | 160/348 |
| 5,012,851 | 5/1991 | Hannerstig | 160/348 |
| 5,141,045 | 8/1992 | Williams | 160/348 |
| 5,217,784 | 6/1983 | Shepherd | 160/38 X |
| 5,238,044 | 8/1993 | Gilley et al. | 160/348 |

*Primary Examiner*—David M. Purol

*Attorney, Agent, or Firm*—Donald A. Kettlestrings

[57] ABSTRACT

A drapery support system includes a mounting bracket for attachment to a vertical or horizontal surface, such as a wall or window. The support system further includes a drapery support defining first and second openings therein of a first predetermined size and shape and further defining third and fourth openings therein of a second predetermined size and shape wherein the drapery support is removably and adjustably connected to the mounting bracket. Various drapery designs and treatments can be quickly and easily created by attaching drapery material to the drapery support in various configurations.

18 Claims, 5 Drawing Sheets

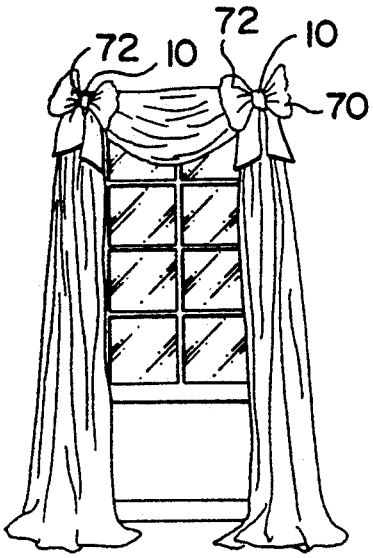
Fig- 9
Fig- 10
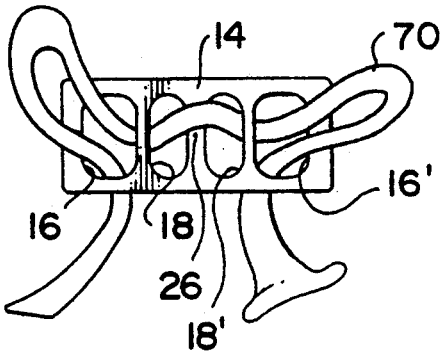
Fig- 11
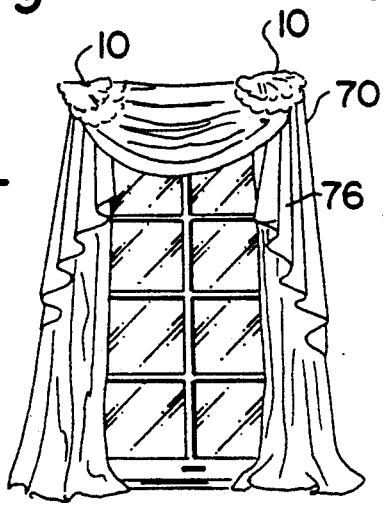
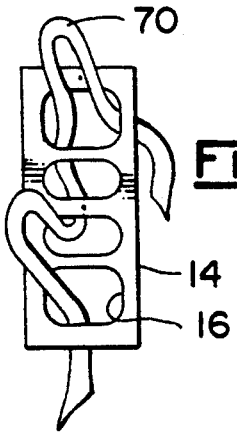
Fig- 12
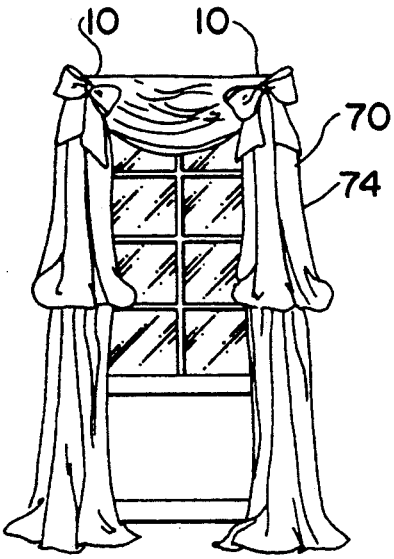
Fig- 13
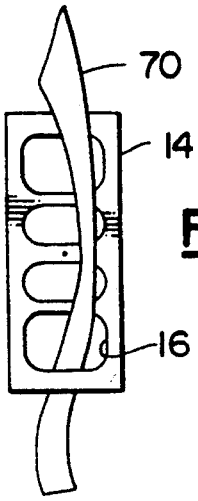
Fig- 14

DRAPERY SUPPORT SYSTEM

BACKGROUND OF THE INVENTION

This invention relates to drapery hardware and more particularly to a drapery support system which enables quick and easy creation of various custom window drapery treatments and configurations.

Custom window drapery configurations and designs can enhance the appearance of windows, and custom window treatments have become very popular in recent years. Unfortunately, it is often necessary to use the services of professional designers to create custom window treatments and the cost of such services can be significant. Heretofore, the creation of custom window drapery treatments has required considerable skills and a great amount of time and effort.

It is, therefore, an object of the present invention to provide improved drapery hardware which enables the quick and easy creation and design of custom window drapery treatments.

Another object is to provide a drapery support system which will enable an individual to quickly and easily create custom window drapery treatments without the need for sewing.

A further object of the invention is the provision of an improved drapery support system which will enable an individual to quickly, easily and inexpensively create custom window drapery treatments without using the services of a professional designer.

Another object is to provide improved drapery support mounting brackets.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a drapery support system which comprises a mounting bracket for attachment to a vertical or horizontal surface; a drapery support defining first and second openings therein of a first predetermined size and shape and further defining third and fourth openings therein of a second predetermined size and shape; first means for removably and adjustably connecting the drapery support to the mounting bracket; and second means for attaching the mounting bracket to the vertical or horizontal surface. The improved drapery support mounting brackets also can be used alone to support drapery swags, for example.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

FIG. 9 shows a Bow drapery design on a window;

FIG. 10 shows the formation of a Bow drapery design on the support shown in FIG. 4;

FIG. 11 shows a Double Flounce drapery design on a window;

FIG. 12 shows the formation of a Double Flounce drapery design on the support shown in FIG. 4;

FIG. 13 shows a Bishop Sleeve drapery design on a window;

FIG. 14 shows the formation of a Bishop Sleeve design on the support system shown in FIG. 4;

DESCRIPTION OF THE PREFERRED EMBODIMENTS

Figure 1:
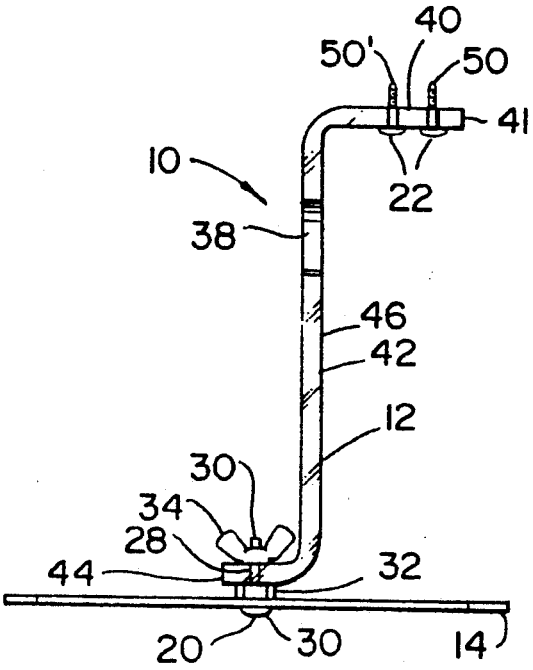
FIG. 1 is a top plan view of one embodiment of the drapery support system.
Figure 2:
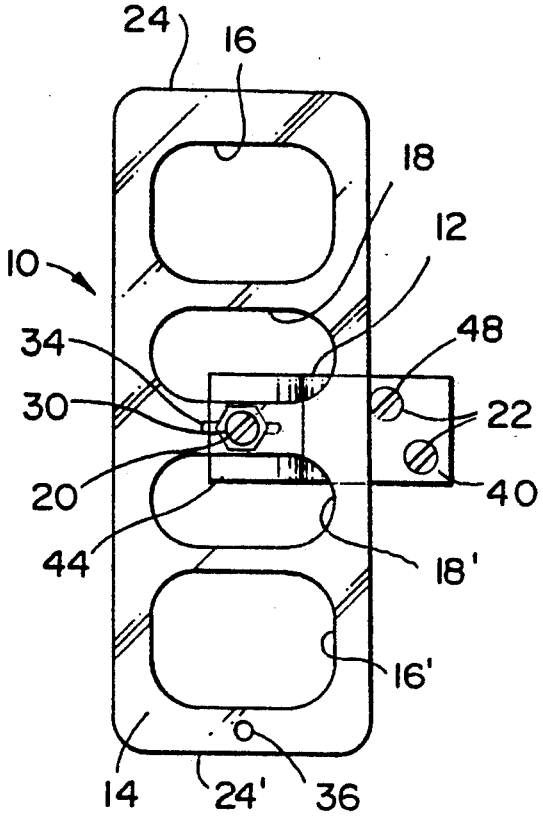
FIG. 2 is a front elevation view of the system.
Figure 3:
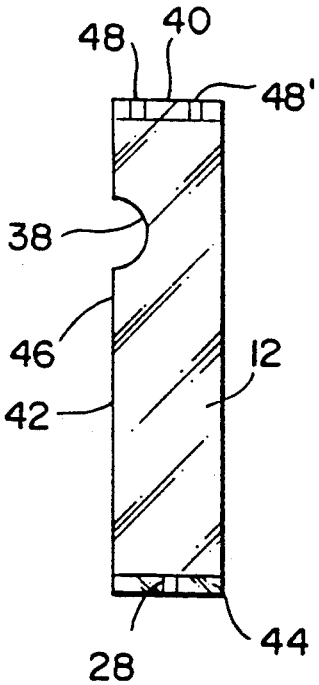
FIG. 3 is an elevation view of a mounting bracket.
Figure 4:
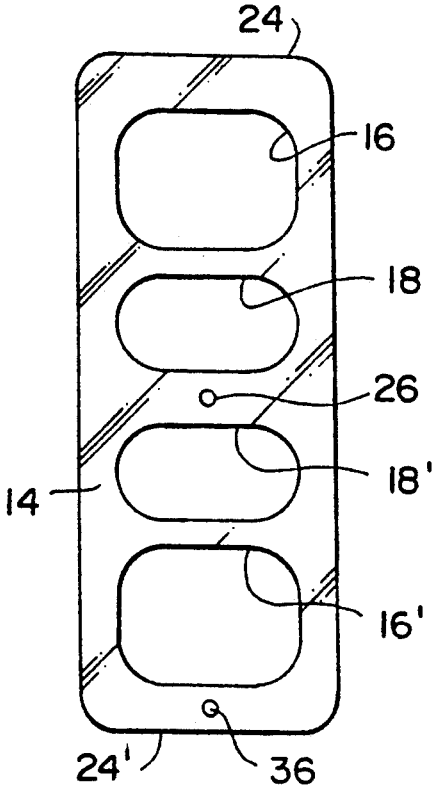
FIG. 4 is an elevation view of a drapery support.

With reference now to the drawings, wherein like reference characters designate like or corresponding parts throughout the several views, there is shown a drapery support system 10 which comprises a first mounting bracket 12 for attachment to a wall. Support system 10 further includes a drapery support 14 which defines first and second openings 16, 16' therein of a first predetermined size and shape. Support 14 further defines third and fourth openings 18, 18' therein of a second predetermined size and shape. It is important that openings 16, 16' each are substantially one and one-half times the area of each of openings 18, 18' to enable the desired drapery designs to be created by use of support 14.

First means 20 are provided for removably and adjustably connecting drapery support 14 to mounting bracket 12, and second means 22 are provided for removably attaching mounting bracket 12 to the wall or other vertical surface.

Drapery support 14 is preferably substantially planar in configuration, as illustrated, and support 14 defines first and second opposed edges 24, 24'. First and second openings 16, 16' are respectively positioned adjacent to first and second opposed edges 24, 24'. Third and fourth openings 18, 18' are positioned adjacent to each other and between first and second openings 16, 16' Openings 16, 16' are substantially equal to each other in size and shape, and openings 18, 18' are substantially equal to each other in size and shape. Each of openings 16, 16' is preferably substantially square in shape, and each of openings 18, 18' is preferably substantially rectangular. The corners of each of openings 16, 16', 18 and 18' are preferably rounded to more readily enable drapery material to be moved into, out of and through the openings.

In accordance with the invention, first means 20 include a first hole 26 defined within drapery support 14 and centrally positioned between openings 18, 18'. First means 20 further include a second hole 28 defined within mounting bracket 12 for positioning in alignment with first hole 26. First means 20 further include a bolt 30 for removably positioning through holes 26 and 28, a first nut 32 for fastening to bolt 30 and for tightening on the bolt to a position on the bolt with nut 32 engaging drapery support 14 before the drapery support is attached to mounting bracket 12. First means 20 further include a second wing nut 34 for fastening to bolt 30 and for tightening on the bolt to a position on the bolt with nut 34 engaging mounting bracket 12 to hold drapery support 14 in position on mounting bracket 12.

In accordance with the invention, first means 20 further include a third hole 36 defined within drapery support 14 and positioned between second opening 16' and second edge 24', whereby drapery support 14 can be attached to mounting bracket 12 by positioning bolt 30 through third hole 36 and through second hole 28.

Mounting bracket 12 preferably defines a substantially semi-circular notch 38 therein for receiving a curtain rod, for a sheer curtain for example, in nesting relationship with notch 38. Drapery support 14 is preferably substantially rectangular in configuration, as shown, to enable support 14 to be easily covered and hidden by drapery material that is attached to support 14.

Mounting bracket 12 includes a rear mounting portion 40, an arm member 42 which extends forwardly and at a substantially right angle from rear mounting portion 40, and a forward mounting portion 44 which extends from arm member 42 and at a substantially right angle with respect to arm member 42. As illustrated, rear mounting portion 40 and forward mounting portion 44 extend from arm member 42 in opposite directions. Arm member 42 defines an upper edge 46, and semi-circular notch 38 is defined within upper edge 46. Second hole 28 is defined within forward mounting portion 44.

In accordance with the invention, second means 22 include first and second mounting openings 48, 48' defined within rear mounting portion 40 and first and second mounting screws 50, 50' for positioning in first and second mounting openings 48, 48', respectively.

In operation and use, support system 10 can be used for creating top of the window treatments with a Swag, as a holder for Bishop's Sleeves or in place of Tiebacks. Installation and creation of custom window drapery treatments using drapery support system 10 takes only minutes.

Drapery support system 10, as described, is used on one side of the window and a similar drapery support system is used on the other side of the window.

Figure 6:
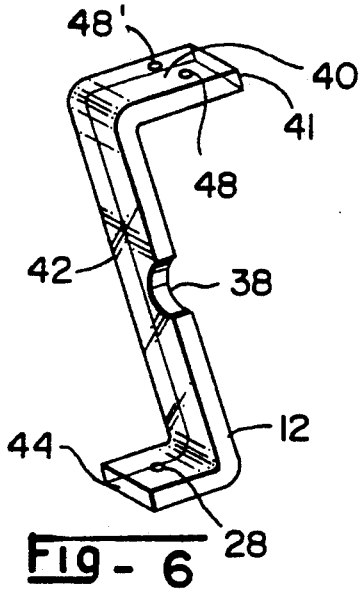
FIG. 6 is a perspective view of the bracket shown in FIG. 3.
Figure 6A:
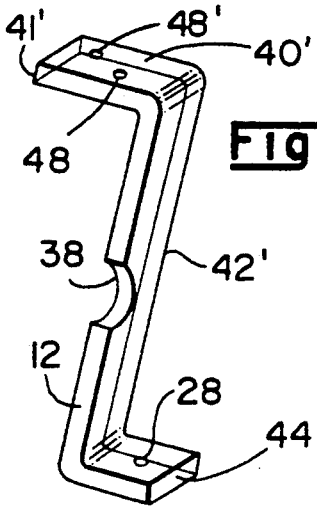
FIG. 6A is a perspective view of another bracket which can be used as a part of the drapery support system and in combination with the bracket shown in FIGS. 3 and 6.
Figure 7:
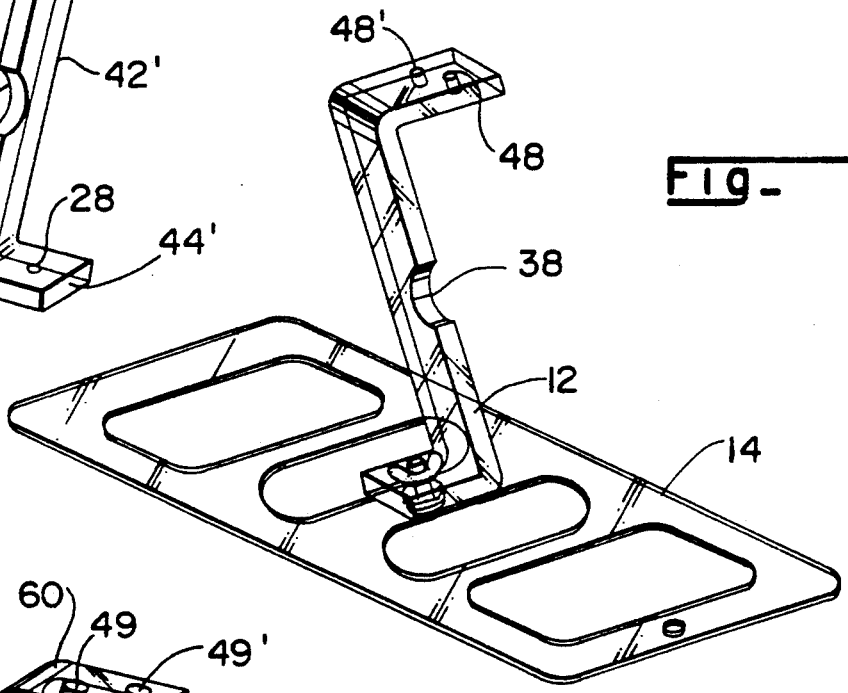
FIG. 7 is a perspective view of the system shown in FIG. 1.
Figure 8:
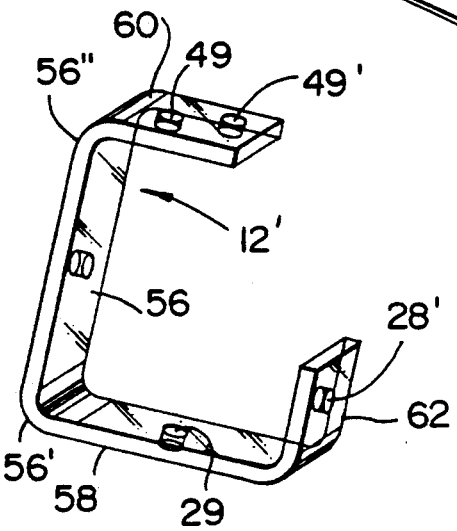
FIG. 8 is a perspective view of the bracket shown in FIG. 5.
Figure 15:
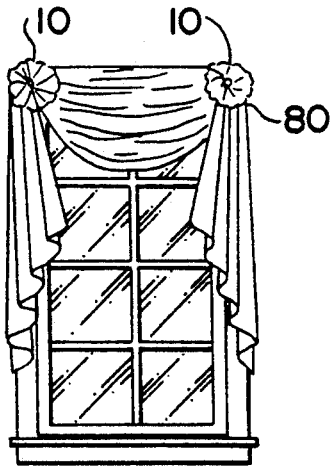
FIG. 15 shows a Double Rosette drapery design on a window.

When installing the drapery support system, bracket 12 is attached to the vertical surface or wall adjacent to the top of the window or at any other desired position with respect to the window. Bracket 12 is positioned with end 41 of rear mounting portion 40 directed toward the window, and mounting screws 50, 50' are positioned through openings 48, 48' to attach mounting bracket 12 to the wall. A similar mounting bracket (shown in FIG. 6A) is attached in a similar manner to the wall on the opposite side of the window. The similar mounting bracket is identical to bracket 12 except that its mounting portions 40', 44' extend in opposite directions, respectively, from its arm member 42' than do mounting portions 40, 44 on bracket 12. Thus ends 41, 41' of each of the mounting brackets are positioned toward the window.

The next step in use of drapery support system 10 is to insert bolt 30 through hole 26 in drapery support 14. Nut 32 is then threaded onto the bolt and tightened against support 14 so that bolt 30 is held in position with respect to drapery support 14. Alternatively, bolt 30 can be similarly positioned through hole 36 and attached to drapery support 14.

The next step is to cut the necessary amount of drapery material for the custom window treatment desired and to attach the material to drapery support 14 in a manner which will create the desired design. The unique sizes, shapes and relative positions of openings 16, 16', 18 and 18' within drapery support 14 enable the drapery material to be held in place and enable quick and easy creation of custom designs.

Figure 5:
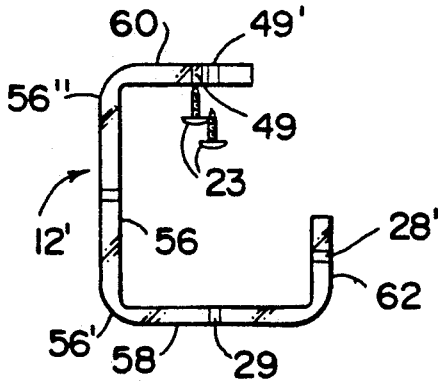
FIG. 5 is a side elevation view of another mounting bracket embodiment.

A second embodiment drapery support mounting bracket 12' is shown in FIG. 5 for use with box, bay or arch windows. Most such windows will require use of four mounting brackets 12', but larger windows will require more brackets. Depending on the desired drapery design, arch windows will usually require a minimum of three brackets 12'.

Mounting bracket 12' includes a first arm element 56 which defines first and second ends 56', 56''. A second arm element 58 extends from first end 56' of first arm element 56, and a third arm element 60 extends from second end 56'' of first arm element 56. A fourth arm element 62 extends from second arm element 58.

Second arm element 58 extends at a substantially right angle from first arm element 56, and third arm element 60 extends at a substantially right angle from first arm element 56. Fourth arm element 62 extends at a substantially right angle from second arm element 58. Third arm element 60 is shorter in length than second arm element 58, and fourth arm element 62 is shorter in length than first arm element 56. A hole 28' is defined within and through fourth arm element 62, and two mounting openings 49, 49' are defined within and through third arm element 60.

In use, mounting bracket 12' can be attached to a horizontal surface associated with a box or bay window, or mounting bracket 12' can be attached to a surface associated with an arch window. Bracket 12' is attached to such a surface by use of screws 23 which are inserted through mounting openings 49, 49' to engage the window surface so that third arm element 60 is positioned against the surface to which bracket 12' is to be mounted. Drapery support 14 can then be attached to bracket 12' at hole 28' in arm element 62 in the same manner as previously described with respect to mounting bracket 12.

Alternatively, bracket 12' can be attached to a vertical surface or wall associated with a window by positioning third arm element 60 adjacent to the vertical surface or wall and by inserting screws 23 through openings 49, 49' to engage the vertical surface or wall. When bracket 12' is mounted to a vertical surface or wall, drapery support 14 can be attached to second arm element 58 via hole 29 in the same manner as previously described when support 14 is attached to bracket 12.

Because of the configuration of mounting bracket 12', it can be used by itself as a swag support when it is attached to a vertical surface and when it is attached to a horizontal surface. In each instance, the configuration of bracket 12' will enable a swag to be draped on bracket 12', and bracket 12' will hold the swag in position without having the swag slip off bracket 12'. For example, when bracket 12' is attached to a horizontal surface, arm element 62 acts to hold the swag in position on bracket 12'. When bracket 12' is attached to a vertical surface, arm elements 58 and 62 act to hold the swag in position on bracket 12' and the swag will not slip off bracket 12'.

Mounting bracket 12 is also configured so it can be used alone as a swag support when it is attached to a vertical surface. The relationship between arm member 42 and forward mounting portion 44 enables a swag to be draped on arm member 42 and forward mounting portion 44 will hold the swag in position without having the swag slip off bracket 12.

In creating a custom drapery treatment it is first necessary to determine the type of drapery fabric to be used and the drapery design to be installed. When using drapery support system 10 with brackets 12 or 12' it will be necessary to measure the length and width of the window to be treated and to determine the "design length" for the particular custom design. If the width of the window is represented by W, the length of the window is represented by L and the "design length" is represented by D, the length of the fabric F is determined by the equation $F=W+L+L+D+12$ inches. Total all the measurements in accordance with the equation to get the measurement in inches and then divide by thirty-six to determine the length of the fabric to be cut in yardage.

In determining the length of fabric to be cut for each individual design, the following design chart should be used to determine the "design length."

| | | | |
|---|---|---|---|
| Bishop's Sleeves | 16 inches | Swag | 15 inches |
| Bow | 36 inches | Heart | 36 inches |
| Flounces | 24 inches | Rose | 30 inches |
| Knots | 22 inches | Petal for Rose | 24 inches |
| Rosette | 24 inches | Crown/Coronet | 36 inches |

The "design length" shown in the preceding chart should be doubled for double designs.

Examples of designs that can be created when using drapery support system 10 with brackets 12 or 12' are illustrated in FIGS. 9-25. After the drapery material 70 has been cut to the desired length and after it has been attached to drapery support 14 to create the desired design, drapery support 14 is then attached to mounting bracket 12 or 12' by inserting bolt 30 through hole 28 of bracket 12 or through hole 28' or hole 29 of bracket 12'. Nut 34 is then tightened onto bolt 30 until nut 34 tightly engages mounting bracket 12 or 12'. Drapery support 14 can be mounted vertically, horizontally or at any desired angle with respect to mounting bracket 12 or 12' to create the desired drapery design, and support 14 can be mounted to bracket 12 or 12' by passing bolt 30 either through hole 26 or through hole 36 in support 14.

Every drapery design begins with a loop of drapery material 70 and every loop is initially treated in the same manner. Take the loop of material 70 in one hand and using the other hand, find the outside edge of the material. Carefully pull or "walk" the material from one hand to the other. If the material is twisted, it should be untwisted. Both hands should then be put inside the loop and the sides of the loop should be laid out in a fan shape. Then the instructions for a specific window treatment design should be followed. Instructions for several examples of specific window treatment designs are described below.

To make a Bow 72 as shown in FIGS. 9 and 10 (the most difficult design to make using known drapery hardware) the proper length of material 70 is cut to a length as determined by the equation set forth above. The material is then gathered at the raw edge. The material is then pulled through opening 18' and across over hole 26 and the material is then pulled through opening 18, as shown in FIG. 10. This will become the knot in the Bow. Then a loop of approximately five inches is pulled up in the material. The loop is then taken in one hand. Using the other hand, the outside edge of the material is located. Then the material is carefully pulled or "walked" from one hand to the other. The material should now be in the opposite hand. If the material is twisted, it should be untwisted. Then both hands are placed inside the loop and the sides of the loop are laid out or fanned. Then the material is pulled from beneath support 14 and downward to form the center of the Bow. A loop of material of approximately five to six inches is then pulled through opening 16' and a loop of the same size is pulled through opening 16. The material in opening 16' should then be "walked" across from one hand to the other. Both hands should then be placed inside the loop associated with opening 16' and the material should then be carefully fanned out into a bow shape to the desired fullness. The same steps should be repeated by forming a loop in the material in opening 16. If a Double Bow is desired, two loops should be pulled through each of openings 16, 16'. The Bow 72 can be set at any desired angle without changing the position of brackets 12, 12' by adjusting the position of support 14 with respect to brackets 12 or 12'.

To create Bishop Sleeves 74 as shown in FIGS. 13 and 14, mount bracket 12 or 12' at the desired height for the Bishop Sleeve and adjacent to the window. Cut the proper length of material 70 in accordance with the equation described above and pleat the material. Attach drapery support 14 to mounting bracket 12 or 12' as previously described, and then pull the hem of the material 70 through the bottom opening 16 or 16' of support 14 and allow the material to fold over bracket 12 or 12'. This is shown in FIG. 14.

A Flounce 76 as shown in FIGS. 11 and 12, is created by pulling a loop of material 70 through any one of openings 16, 16', 18 or 18' in support 14. Then as previously described, the material should be "walked" and fanned. For a Double Flounce, two loops of material should be pulled through any one of the openings in support 14. For a Triple Flounce, three loops of material should be used in accordance with the Bow illustration shown in FIG. 10 and as previously described. Flounces can be mounted vertically or horizontally and can be of varying sizes. FIG. 12 shows a Double Flounce.

Figure 19:
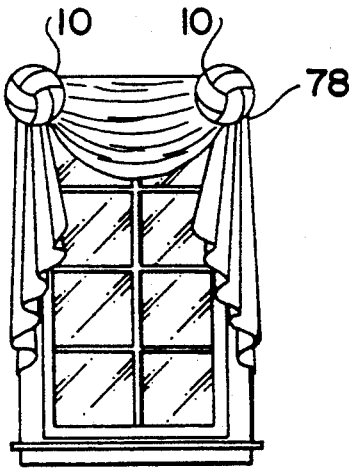
FIG. 19 shows a Knot drapery design on a window.
Figure 20:
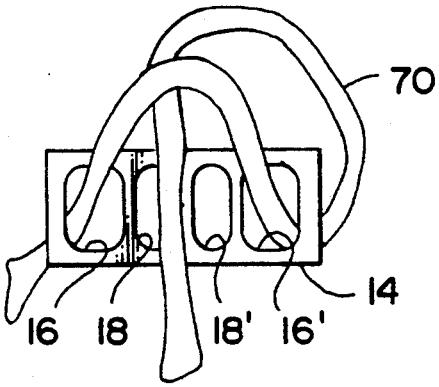
FIG. 20 shows the formation of a Knot design on the support shown in FIG. 4.
Figure 21:
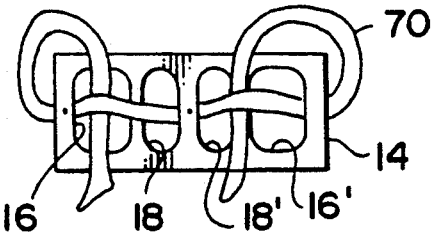
FIG. 21 shows the formation of a Double Knot design on the support shown in FIG. 4.
Figure 22:
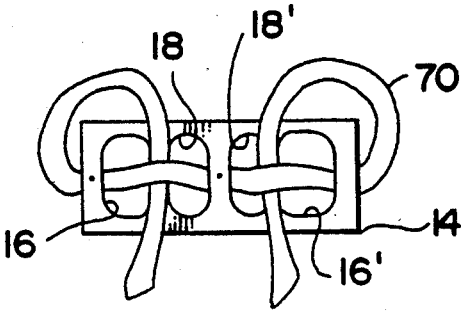
FIG. 22 shows the formation of a Coronet design on the support shown in FIG. 4.

Knots 78 are created as illustrated in FIGS. 19 and 20. Knots are made by pulling material 70 through openings 16 and 16', as shown in FIG. 20, then pulling material over the top center of drapery support 14. Arrange folds of the material to complete the Knot. For a Double Knot the material is pulled through openings 16', 18' and 18, 16 and the tails of the material are pulled over the loops as when making a knot. See FIG. 21.

Figure 16:
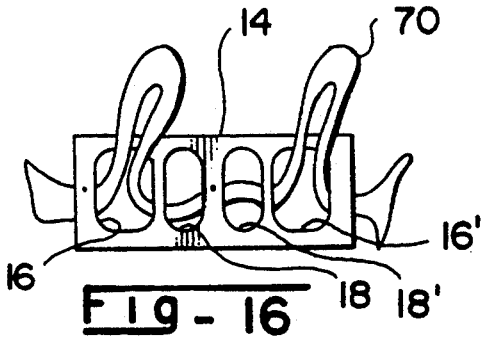
FIG. 16 shows the formation of a Double Rosette design on the support shown in FIG. 4.

A single Rosette 80 is a loop pulled through any opening 16, 16', 18 or 18' in support 14. The material 70 is then "walked" from one hand to the other and then fanned out. The loop is typically four to five inches in length but can be larger. One end of the loop is then tucked into the other. A Double Rosette is made by pulling loops through openings 16' and 16. For larger Rosettes, openings 16', 18' and 18, 16 are used. FIG. 16 shows creation of a Double Rosette.

Figure 17:
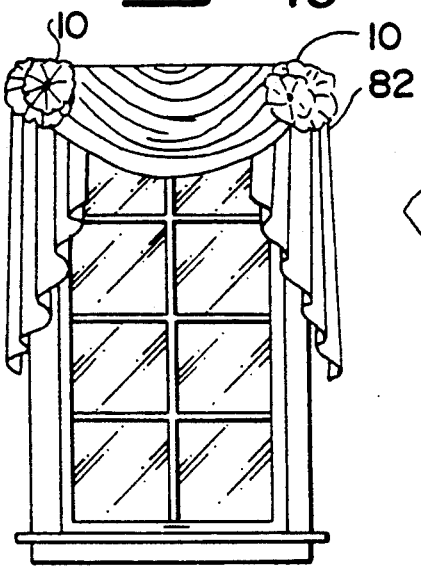
FIG. 17 shows a Rose drapery design on a window.
Figure 18:
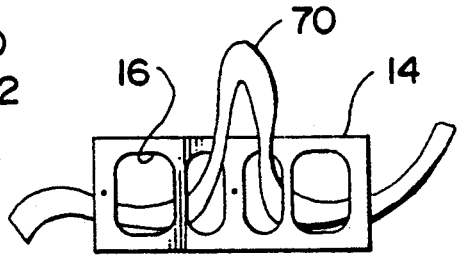
FIG. 18 shows the formation of a Rose design on the support shown in FIG. 4.

Creating a Rose 82 is shown in FIGS. 17 and 18. A Rose is simply a Rosette with a twist. The directions for creating a Rosette should be followed but without tucking one end into the other. One end of the loop can be twisted several turns to create the petal loop of a rose. The other end of the loop should be tucked into the bottom of the Rose. A Double Rose is created by using the instructions for the Double Rosette.

Figure 23:
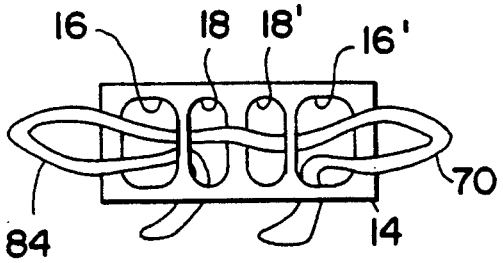
FIG. 23 shows the formation of a Petal design on the support shown in FIG. 4.
Figure 24:
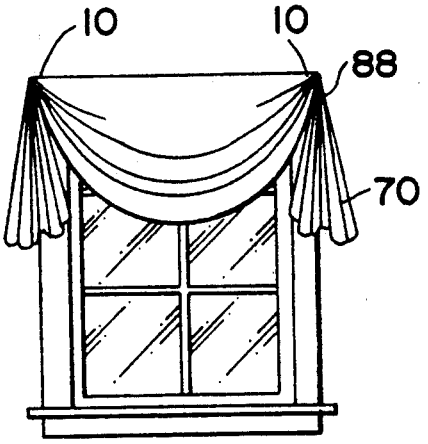
FIG. 24 shows a Swag drapery design on a window.
Figure 25:
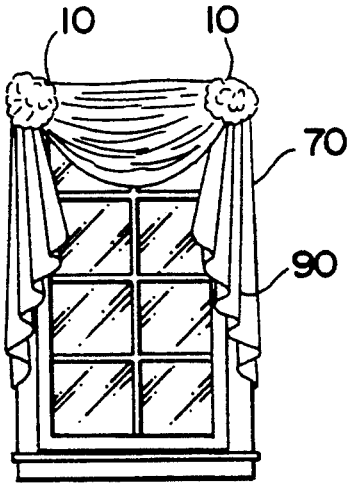
FIG. 25 shows a Jabot or jagged edge drapery design on a window.

Creating Petals 84 is illustrated in FIG. 23. Petals can be added to any design by pulling a contrasting material through openings 18, 18' and then pulling loops of material through openings 16,16'.

Creating Hearts (not shown) is done by beginning with the instructions for creating Bows 72. Then the top of the Bow loops are tucked into the top of openings 18 and 16. The bottom of the Bow loops are pulled into points and tucked inside each other. Then the material is shaped for a Heart.

Crowns or Coronets are used with Flounces or Knots. The top of the loop of material 70 is pulled into a fan shape, tucking the ends into the top of the openings in support 14. See FIG. 22.

Swags 88 are created by using the center of the cut material 70 as a guide and placing ends of the material over the edge of mounting brackets 12 or 12'. By pulling from the middle of the material hanging in the center of the window, the Swag can be set to the desired depth. The Swag can be straightened by pulling the outer edges of the material near brackets 12 or 12'. See FIG. 24.

A Jabot 90 or jagged edge effect can also be created by use of support system 10. See FIG. 25.

Various other designs can be created by use of support system 10 which have not been specifically described herein.

Mounting brackets 12, 12' and drapery support 14 are preferably comprised of plastic material, such as Lexann.

The invention in its broader aspects is not limited to the specific details shown and described, and departures may be made from such details without departing from the principles of the invention and without sacrificing its chief advantages.

What is claimed is:

1. A drapery support system comprising:

a mounting bracket;

a drapery support, substantially planar in configuration, defining first and second openings therein of a first predetermined size and shape and further defining third and fourth openings therein of a second predetermined size and shape;

said drapery support defining first and second opposed edges and wherein said first and second openings are respectively positioned adjacent to said first and second opposed edges;

said third and fourth openings positioned adjacent to each other and between said first and second openings;

each of said first and second openings being larger in area than each of said third and fourth openings;

first means for removably and adjustably connecting said drapery support to said mounting bracket;

second means for attaching said mounting bracket to a vertical or horizontal surface, such as a wall or a window; and wherein said first means include:

a first holed defined within said drapery support and positioned between said third and fourth openings;

a second hole defined within said mounting bracket for positioning in alignment with said first hole;

a bolt for removable positioning through said first and second holes;

a first nut for fastening to said bolt and for tightening on said bolt to a position on said bolt with said first nut engaging said drapery support before said drapery support is attached to said mounting bracket; and a second nut for fastening to said bolt and for tightening on said bolt to a position on said bolt with said second nut engaging said mounting bracket to hold said drapery support in position on said mounting bracket.

2. A drapery support system as in claim 1 wherein said first means further include a third hole defined within said drapery support and positioned between said second opening and said second edge, whereby said drapery support can be attached to said mounting bracket by positioning said bolt through said third hole and through said second hole.

3. A drapery support system as in claim 2 wherein said mounting bracket defines a substantially semi-circular notch therein for receiving a curtain rod in nesting relationship therewith.

4. A drapery support system as in claim 3 wherein said drapery support is substantially rectangular in configuration.

5. A drapery support system as in claim 4 wherein said mounting bracket includes:

a rear mounting portion;

an arm member extending forwardly and at a substantially right angle from said rear mounting portion; and a forward mounting portion extending from said arm member and at a substantially right angle with said arm member.

6. A drapery support system as in claim 5 wherein said arm member defines an upper edge and wherein said semi-circular notch is defined within said upper edge.

7. A drapery support system as in claim 6 wherein said second hole is defined within said forward mounting portion.

8. A drapery support system as in claim 7 wherein said rear mounting portion and said forward mounting portion extend from said arm member in opposite directions.

9. A drapery support system as in claim 8 wherein said second means include first and second mounting openings defined within said rear mounting portion and first and second mounting screws for positioning in said first and second mounting openings, respectively.

10. A drapery support system as in claim 9 wherein each of said first and second openings is substantially one and one-half times greater in area than each of said third and fourth openings.

11. A drapery support system as in claim 2 wherein said mounting bracket includes;

a first arm element;

a second arm element extending from said first arm element;

a third arm element extending from said first arm element; and a fourth arm element extending from said second arm element.

12. A drapery support system as in claim 11 wherein said second arm element extends at a substantially right angle from said first arm element.

13. A drapery support system as in claim 12 wherein said third arm element extends at a substantially right angle from said first arm element.

14. A drapery support system as in claim 13 wherein said fourth arm element extends at a substantially right angle from said second arm element.

15. A drapery support system as in claim 15 wherein said third arm element is shorter in length than said second arm element.

16. A drapery support system as in claim 15 wherein said fourth arm element is shorter in length than said first arm element.

17. A drapery support system as in claim 16 wherein said second hole is defined within said fourth arm element.

18. A drapery support system as in claim 17 wherein said second means include first and second mounting openings defined within said third arm element.

* * * * *